US007270331B1

(12) United States Patent
Feola

(10) Patent No.: US 7,270,331 B1
(45) Date of Patent: Sep. 18, 2007

(54) METHOD OF PLAYING A BONUS

(75) Inventor: John Feola, North Reading, MA (US)

(73) Assignee: New Vision Gaming & Development, Inc., North Reading, MA (US)

( * ) Notice: Subject to any disclaimer, the term of this patent is extended or adjusted under 35 U.S.C. 154(b) by 0 days.

(21) Appl. No.: 11/305,175

(22) Filed: Dec. 17, 2005

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 6,070,873 A * 6/2000 Perkins ..... 273/292
6,227,969 B1 * 5/2001 Yoseloff ..... 463/13
6,234,485 B1 * 5/2001 Perkins ..... 273/292
6,299,170 B1 * 10/2001 Yoseloff ..... 273/292
6,481,717 B1 * 11/2002 Richardelle ..... 273/292
6,607,195 B2 * 8/2003 Vancura ..... 273/274
6,659,461 B2 * 12/2003 Yoseloff et al. ..... 273/274
6,789,801 B2 * 9/2004 Snow ..... 273/292
6,808,174 B1 * 10/2004 Rubin ..... 273/292
6,869,076 B1 * 3/2005 Moore et al. ..... 273/292
7,032,902 B1 * 4/2006 Yuan ..... 273/274
7,128,645 B1 * 10/2006 White et al. ..... 463/13
7,144,321 B2 * 12/2006 Mayeroff ..... 463/16

* cited by examiner

*Primary Examiner*—Eugene Kim
*Assistant Examiner*—Dolores R. Collins
(74) *Attorney, Agent, or Firm*—Altman & Martin; Steven K. Martin

(57) ABSTRACT

A method of playing a game bonus triggered by the rank of the player hand. A plurality of bonus hands is provided and a value is assigned to each one. The player chooses one of the bonus hands, after which the value is revealed and the player is paid the corresponding amount. The values assigned guarantee the player a payout regardless of the choice. Optionally, the player may be permitted to choose more than one bonus hand. The number of bonus hands permitted may be based on the rank of the player hand. The value of the bonus hand may be represented by a poker hand.

15 Claims, 3 Drawing Sheets

| Poker Hand | Value |
|---|---|
| Royal Flush | 50 |
| Straight Flush | 25 |
| Four of a Kind | 10 |
| Full House | 5 |
| Flush | 2 |
| Straight | 1 |

METHOD OF PLAYING A BONUS

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to gaming, more particularly, to a bonus for casino and lottery games.

2. Description of the Related Art

Many games, such as casino card games, have side or bonus bets. In the typical side bet, a player wagers that the ranking of a predetermined set of cards that are dealt during the game will be found in a pay table. The side bet is independent of the game, so a player can win one but not the other. Side bets and bonuses are popular because they add excitement to a game and increase its potential without adding much extra time to play the game.

BRIEF SUMMARY OF THE INVENTION

An object of the present invention is to provide a bonus triggered by the outcome of a game.

Another object is to provide a bonus that is itself fun to play and that adds interest to the game.

The present invention is a bonus adjunct to a game that is triggered when the player hand has a certain minimum rank. The player is presented with two or more bonus hands from which to choose. Each bonus hand has a value associated with it that guarantees the player a bonus payout regardless of the choice. The value may be an absolute amount or it may be a multiplier. An absolute amount is the payout amount. A multiplier determines the payout as a multiple of the amount the player won for the player hand that triggered the bonus.

Markers initially represent the bonus hands so the payout values are hidden. The player chooses a bonus hand from the markers presented. After a bonus hand is chosen, its value is revealed. The payout amount may be directly revealed or a representation of the payout amount may be revealed, for example, a poker hand, where the poker hand rank is directly related to the value.

Values are assigned to the bonus hands from a pool of possible values, called selections. Each selection has only one value, but more than one selection may have the same value. In one method, there are the same number of selections as there are bonus hands, and the selections are randomly assigned. In another method, there are more selections in the pool than there are bonus hands, and each of the bonus hands is randomly assigned one of the selections from the pool Another embodiment, the bonus hands are displayed as matrix of playing cards. Hands are made from each row, column, and diagonal of card locations. The player chooses a hand by selecting a button representing the desired hand, after which the chosen hand is revealed.

The bonus of the present invention may be played in a number of different environments, including, but not limited to, video poker, video keno, lottery-style keno, and slot machines.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
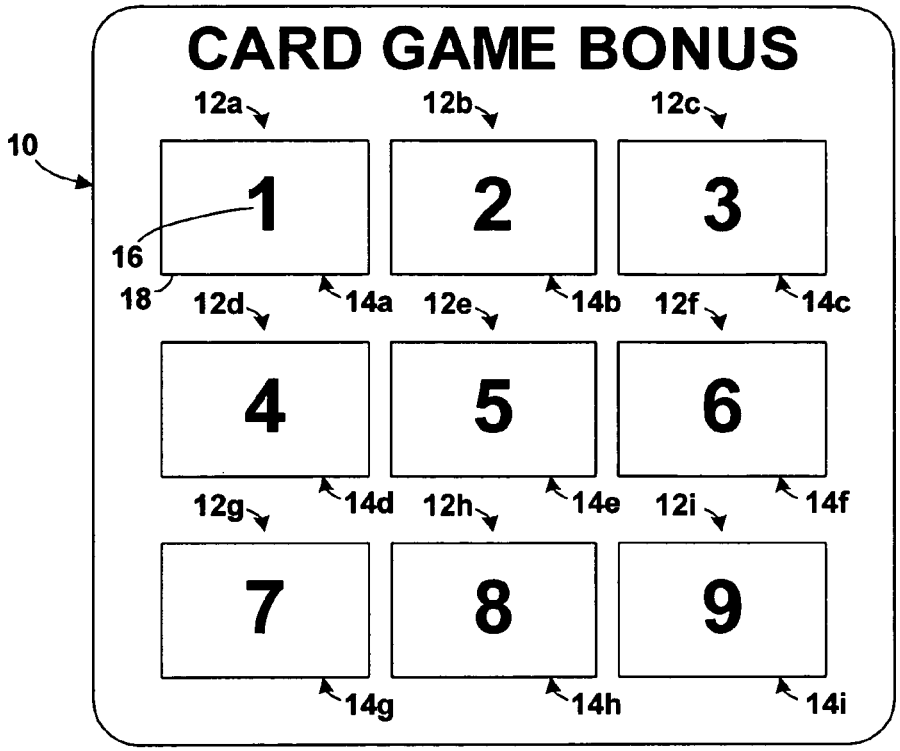
FIG. 1 shows one example of an initial bonus display screen of the present invention.

The present invention is a bonus adjunct to a card game where a player wins more if certain events occur. An example of a game with which the bonus of the present invention can be used is disclosed in U.S. Pat. No. 5,664,781. In the game of the '781 patent, a player chooses one or more of a plurality of player hands, and the player wins if one of the chosen player hands is the highest ranked of the player hands.

Typically, a player participating in a game automatically participates in a bonus, that is, a player does not have to pay an additional amount to participate in the bonus. This is the preferred embodiment of the present invention. However, the present invention contemplates that the bonus may be run as a side bet for which the player must wager an additional amount to participate.

The bonus of the present invention is triggered when a player hand has a certain minimum rank. What constitutes a player hand and its rank depends on what the game is. The bonus of the present invention works most easily in a video poker environment, but can work with any type of game on any type of media where there is a set of cards or other tokens that makes up a hand that can have a predetermined combination or rank. In card games, like video poker, the player hand is the combination of cards, the rank is the particular combination of cards, and the bonus is triggered if the rank. In keno, the numbers picked by the player is the hand and the number of correct numbers is the rank. If the player picks a predetermined minimum number of correct numbers, the bonus is triggered. In video keno, the bonus is triggered in the same manner as video poker, immediately on the video display. In lottery-style keno, where the player selects numbers via a paper ticket, the player inserts the ticket with a predetermined combination into a kiosk or similar system, which displays the bonus. On a slot machine, the combination of symbols that the wheel stops on is the hand, and the particular combination of symbols is the rank. If the particular combination is a predetermined combination, the bonus is triggered.

As indicated above, the bonus is triggered when the player hand has a predetermined minimum rank. For example, if the player hand has a full house or better, the bonus is triggered. In one embodiment of the present invention, the rank of the winning player hand triggers the bonus. In another embodiment, any player hand that is of a certain minimum rank triggers the bonus, whether or not the hand is the winning player hand. In yet another embodiment, the bonus is triggered randomly, that is, the rank of a player hand does not determine if the bonus will be triggered; the occurrence of a random event triggers the bonus.

Typically, the bonus of the present invention is triggered after the hands are revealed and the payouts for the game are distributed appropriately. Alternatively, the bonus is triggered after all of the hands are revealed and the winning hand is determined, but before payouts are made.

In the bonus of the present invention, the player is presented with a bonus display 10 showing two or more bonus hands 12*a*-12*i* (collectively, 12), each represented by a marker 14*a*-14*i* (collectively, 14), as shown in the example. of FIG. 1. The present invention does not provide an upper limit to the number of bonus hands 12, although there may be practical considerations. The number of bonus hands 12 may be fixed from game to game, or the number of bonus hands 12 may vary depending on one or more of different factors. An example of one such factor is the rank of the player hand that triggered the bonus. The number of bonus hands 12 may be chosen at random from game to game.

Every bonus hand 12 has a non-zero value associated with it. A non-zero value means that the player is guaranteed a bonus payout regardless of the choice.

However, bonus hands 12 may have different values, and it is up to the player to choose the bonus hand 12 that she believes has the highest value in order to maximize her winnings. The value may be an absolute amount or it may be a multiplier. With an absolute amount, the payout amount that the player receives is the value shown or represented, for example, $5. With a multiplier, the payout amount that the player receives is the value times the amount the player received for the player hand that triggered the bonus. For example, if the value is 5×, the player receives a payout amount that is 5 times the amount won by the player for the player hand. Unless otherwise indicated, references in the present specification to bonus hand values include both absolute amounts and multipliers.

Markers 14 initially represent the bonus hands 12 so that the values are hidden. In the example of FIG. 1, there are nine markers 14*a*-141, each represented by a unique number 16 in a box 18. Any form of marker 14 that allows the player to uniquely identify a bonus hand 12 can be used. The markers 14 can take many different forms. For example, the markers 14 can be unique people, animals, plants, or other objects, they can be geometric figures, etc. Video permits animated labels.

The player chooses a bonus hand 12 from the markers 14 presented. Optionally, the player can choose more than one bonus hand 12. Optionally, the number of bonus hands 12 that the player is permitted to choose depends upon the rank of the player hand. For example, if the player hand has a straight, the player can choose only one bonus hand 12, but if the player hand has four of a kind, the player can choose three bonus hands 12. The present invention contemplates that any manner of choosing the bonus hand or hands 12 can be employed, including, for example, a touch screen, a keypad, a keyboard, etc.

Figure 2:
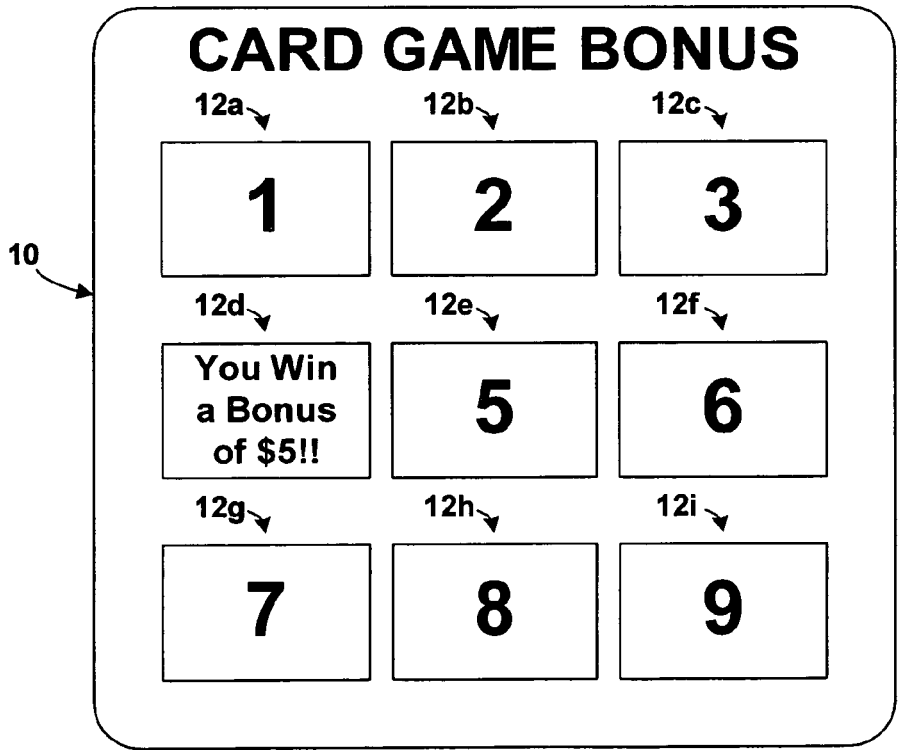
FIG. 2 shows an example display after the chosen bonus hand is revealed.

After a bonus hand 12 is chosen, its value is revealed. In one embodiment, the value is directly revealed as a payout amount. An example of such an embodiment is shown in FIG. 2, where the player chose bonus hand 4 12*d*, which was revealed as having a $5 payout amount. When more than one bonus hand 12 is chosen, the total bonus payout may be the payout amount of the highest-ranked bonus hand 12 or some combination of the payout amounts of all the chosen bonus hands 12.

Figures 3, 4:
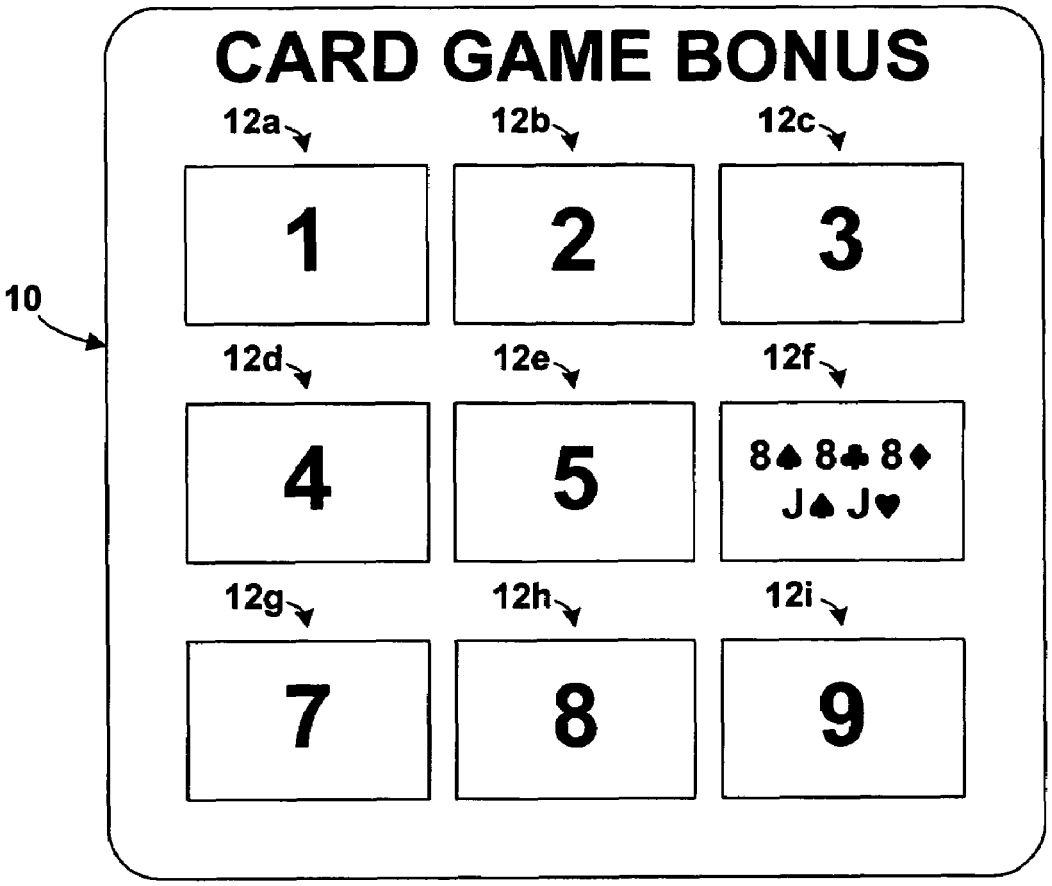
FIG. 3 shows another example display after the chosen bonus hand is revealed.
FIG. 4 is an example table of bonus poker hands with corresponding values.

In another embodiment, a poker hand representing the value is revealed. An example is shown in FIG. 3, where the player chose bonus hand 6 12*f*, revealing a full house consisting of 8 of spades, 8 of clubs, 8 of diamonds, jack of spades, and jack of hearts. Typically, there are five or seven cards in the poker hand. The present invention, however, contemplates that there may be as few as two cards in each poker hand. Typically, the rank of the poker hand is directly related to the value, that is, the higher the rank, the greater the value. An example of such a relationship is shown in the table of FIG. 4. For the example of FIG. 3, the player receives $5, the payout amount represented by a full house. Typically, the poker hand for each bonus hand is unique, although there may be multiple poker hands with the same rank, and hence the same value. In other words, for example, there may be a number of poker hands with a straight, but each poker hand has a different straight.

The payout amount may be revealed with the poker hand so the player does not have to consult a table to know what the payout amount is for the revealed hand.

The present invention contemplates that the payout amount may be anything of value, such as cash, credit, vouchers, tokens, etc. The payout may be a prize other than money and monetary equivalents.

The present invention contemplates several different methods for assigning values to the bonus hands. In general, values are assigned from a pool of possible values, called selections. Each selection has only one value, but more than one selection may have the same value.

In an example, a pool of 25 selections has 14 $2 values, seven $5 values, three $10 values, and one $25 value.

When the selections are poker hands that represent values, the combination of cards that make up each poker hand selection may be the same from game to game or they may be generated for each game. For example, if two selections are straight flushes, the same two straight flushes may be used every time the bonus is triggered, or different straight flushes may be generated each time the bonus is triggered.

In one method of assigning values, there are the same number of selections as there are bonus hands. The selections are randomly assigned to the bonus hands, where a selection is assigned only once, so that all the selections are assigned. Sometime before the chosen bonus hand or hands are revealed, the nine selections are randomly assigned to the nine bonus hands. With this method, the same number of each value will be available every time the bonus of the present invention is played. In one example, there are nine bonus hands and nine possible selections: five $2 payouts, three $5 payouts, and one $10 payout. Every one of the nine selections are available every time the bonus is triggered.

In another method, there are more selections in the pool than there are bonus hands. Sometime before the chosen bonus hand or hands are revealed, each of the bonus hands is randomly assigned one of the selections from the pool, where each selection is assigned only once. In one example, there are nine bonus hands and 30 possible selections: 15 $2 values, eight $5 values, four $10 values, two $25 values, and one $50 value. Because there are nine bonus hands, there will always be nine selections assigned, but precisely which nine selections of the 30 that are assigned each time the bonus is triggered is random.

Figure 5:
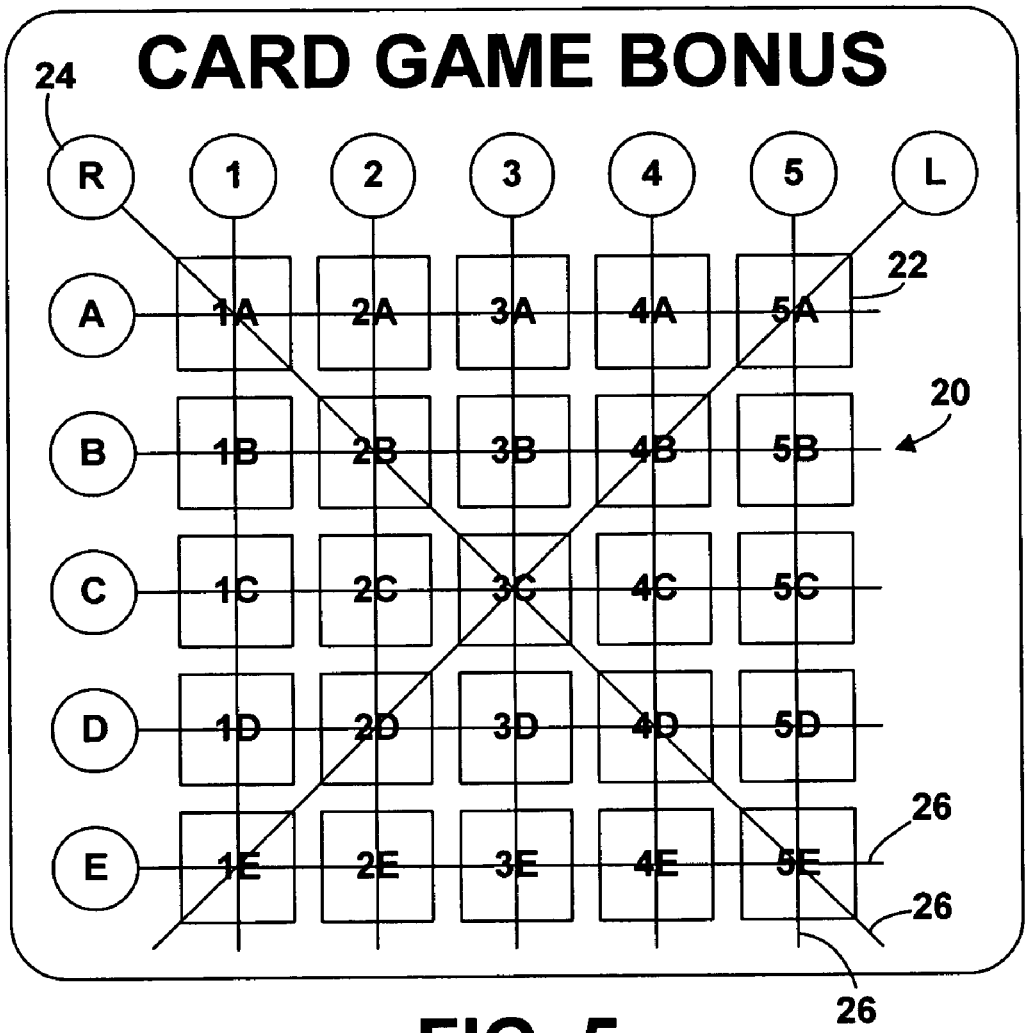
FIG. 5 is an example display of another embodiment of the bonus of the present invention.

Another embodiment of the bonus of the present invention is shown in FIG. 5. Rather than displaying a plurality of bonus hands, this embodiment displays a matrix 20 of locations 22, where each location 22 represents a playing card. In the example of FIG. 5, the matrix 20 is five cards by five cards. It is possible to make 12 rows of five cards from this matrix (five across, five down, and two diagonally. The player chooses a hand by selecting the button 24 representing the desired hand, as shown lines 26. After the button 24 is selected, the cards of the chosen hand are revealed. As with the embodiment above, the player receives a payout regardless of the hand that is chosen, but the hands may have different payouts amounts.

Thus it has been shown and described a game bonus which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A method of playing a bonus to a game wherein a player has a player hand with a rank, said method comprising the steps of:

(a) determining if said player hand rank has a predetermined rank;

(b) presenting a plurality of bonus hands if said player hand has said predetermined rank, the number of said plurality of bonus hands being determined by said player hand rank;

(c) assigning a non-zero value to each of said bonus hands, said value being hidden from said player;

(d) said player choosing at least one of said bonus hands as chosen bonus hands while said values are hidden;

(e) revealing said value for each of said chosen bonus hands; and (f) paying said player a bonus payout corresponding to the value of at least one of said chosen bonus hands.

2. The method of claim 1 wherein said values are assigned randomly to said bonus hands from a pool of selections.

3. The method of claim 1 wherein said value is represented by a poker hand.

4. The method of claim 1 wherein said bonus payout is said value of the highest ranked of said chosen bonus hands.

5. The method of claim 1 wherein said bonus payout is a winning amount for said player hand multiplied by said value.

6. A method of playing a bonus to a game wherein a player has a player hand with a rank, said method comprising the steps of:

(a) determining if said player hand rank has a predetermined rank;

(b) presenting a plurality of bonus hands if said player hand has said predetermined rank;

(c) assigning a non-zero value to each of said bonus hands, said value being hidden from said player;

(d) said player choosing a number of said bonus hands as chosen bonus hands while said values are hidden, said number being determined by said player hand rank;

(e) revealing said value for each of said chosen bonus hands; and (f) paying said player a bonus payout corresponding to the value of at least one of said chosen bonus hands.

7. The method of claim 6 wherein said values are assigned randomly to said bonus hands from a pool of selections.

8. The method of claim 6 wherein said value is represented by a poker hand.

9. The method of claim 6 wherein said bonus payout is said value of the highest ranked of said chosen bonus hands.

10. The method of claim 6 wherein said bonus payout is a winning amount for said player hand multiplied by said value.

11. A method of playing a bonus to a game wherein a player has a player hand with a rank, said method comprising the steps of:

(a) determining if said player hand rank has a predetermined rank;

(b) presenting a plurality of bonus hands if said player hand has said predetermined rank;

(c) assigning a non-zero value to each of said bonus hands, said value being represented by a poker hand, and said value being hidden from said player;

(d) said player choosing at least one of said bonus hands as chosen bonus hands while said values are hidden;

(e) revealing said value for each of said chosen bonus hands; and (f) paying said player a bonus payout corresponding to the value of at least one of said chosen bonus hands.

12. The method of claim 11 wherein said poker hand has a rank that is related to said value.

13. The method of claim 11 wherein said values are assigned randomly to said bonus hands from a pool of selections.

14. The method of claim 11 wherein said bonus payout is said value of the highest ranked of said chosen bonus hands.

15. The method of claim 11 wherein said bonus payout is a winning amount for said player hand multiplied by said value.

* * * * *